United States Patent [19]

Van de Loock

[11] 4,089,485

[45] May 16, 1978

[54] REEL FOR THE STORAGE OF FILAMENTARY MATERIAL

[75] Inventor: Guido Van de Loock, Hemiksem, Belgium

[73] Assignee: Bekaert-Cockerill, Hemiksem, Belgium

[21] Appl. No.: 791,045

[22] Filed: Apr. 26, 1977

Related U.S. Application Data

[63] Continuation-in-part of Ser. No. 686,007, May 13, 1976, Pat. No. 4,032,078.

[51] Int. Cl.[2] ..... B65H 75/20

[52] U.S. Cl. ..... 242/77.2

[58] Field of Search ..... 242/77.2, 77, 71.8, 242/77.3, 115, 116, 118.8, 129

[56] References Cited

U.S. PATENT DOCUMENTS

| | | | |
|---|---|---|---|
| 1,844,494 | 2/1932 | Anderson | 242/77.2 |
| 3,977,622 | 8/1976 | Fecher | 242/77.2 |
| 4,032,078 | 6/1977 | Van de Loock | 242/77.2 |

*Primary Examiner*—Edward J. McCarthy
*Attorney, Agent, or Firm*—Edward J. Brenner

[57] ABSTRACT

A reel for the storage of filamentary material which comprises a plurality of elements each made of a single piece of wire bent to form a sector of the reel and all secured together in a circular array, in which each element has two axially spaced circumferentially extending inner rim portions at the radially innermost regions thereof, all of the inner rim portions of the respective elements co-operating to define two axially spaced bearing rings for mounting the reel on a shaft. Each element is formed to provide two mutually opposed portions of respective rims of the reel, first and second side members extending radially inwardly from respective ends of each rim portion, and an axially extending transverse member between the first side members to form a supporting member for the filamentary material, and the inner rim portions extend from the radially innermost ends of the second side members. Each inner rim portion has, at its end remote from its respective side member, a radially outwardly extending stub member, each stub member being secured to the second member of an adjacent element whereby the inner rim portions are joined together to define said rings. Preferably each element includes a further transverse member extending between the radially outer ends of the stub members of that element.

4 Claims, 5 Drawing Figures

REEL FOR THE STORAGE OF FILAMENTARY MATERIAL

CROSS-REFERENCE TO RELATED APPLICATIONS

The present patent application is a continuation-in-part of my copending patent application Ser. No. 686,007 filed on May 13, 1976 now U.S. Pat. No. 4,032,078.

BACKGROUND OF THE INVENTION

The present invention relates to reels for the storage of filamentary material — e.g. wire — and is an improvement in or modification of the invention of my aforesaid co-pending patent application Ser. No. 686,007, now U.S. Pat. No. 4,032,078.

My aforementioned patent application Ser. No. 686,007 is concerned with a reel for the storage of filamentary material, which comprises a plurality of elements each made of a single piece of wire bent to form a sector of the reel and all secured together in a circular array. In one embodiment the application discloses a reel in which the radially innermost portions of at least some of the elements are secured to a pair of central bearing rings for the reel.

SUMMARY OF THE INVENTION

According to the present invention there is provided a reel for the storage of filamentary material, comprising a plurality of elements each made of a single piece of wire bent to form a sector of the reel and all secured together in a circular array, in which each element has two axially spaced circumferentially extending inner rim portions at the radially innermost regions thereof, all of said inner rim portions of the respective elements co-operating to define two axially spaced bearing rings for mounting the reel on a shaft.

It will be appreciated that such an arrangement has the advantage that all of the elements can be interconnected by spotwelding, particularly in the regions thereof where the filamentary material is wound in use. The reel can be so formed that no cut ends or wire or welding burrs such as result from butt-welding are located where they might injure a user or damage the material to be stored on the reel.

BRIEF DESCRIPTION OF THE DRAWINGS

Several embodiments of the invention will now be described, by way of example only, with reference to the accompanying drawings, in which.

DESCRIPTION OF THE PREFERRED EMBODIMENTS

Figure 1:
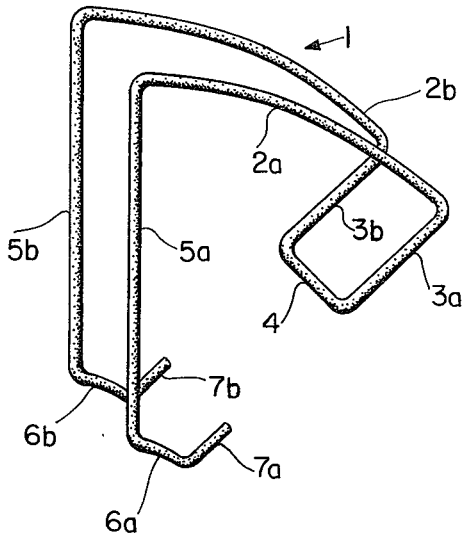
FIG. 1 is a perspective view of a reel element made from a single length of wire.

FIG. 1 shows a three-dimensional element 1 made from a single piece of metal wire. The element has two arcuate rim portions 2a, 2b which are arranged side by side and, in the constructed reel, form portions of the reel rims. Each rim portion 2a, 2b has a side member (3a, 3b respectively) extending, in the constructed reel, radially inwardly; a transverse member 4, which, in use, supports filamentary material wound on the reel, extends between the side members. At the other ends of the rim portions are longer side members 5a, 5b which also extend radially inwardly, at an angle of 45° to the side members 3a, 3b. From the radially inner ends of the side members 5a, 5b extend respective arcuate inner rim portions 6a, 6b, generally parallel to the rim portions 2a, 2b and which terminate in radially outwardly extending stubs 7a, 7b collinear with the side members 3a, 3b respectively.

The element 1 may conveniently be made by bending a planar U-shaped loop of wire.

Figure 2:
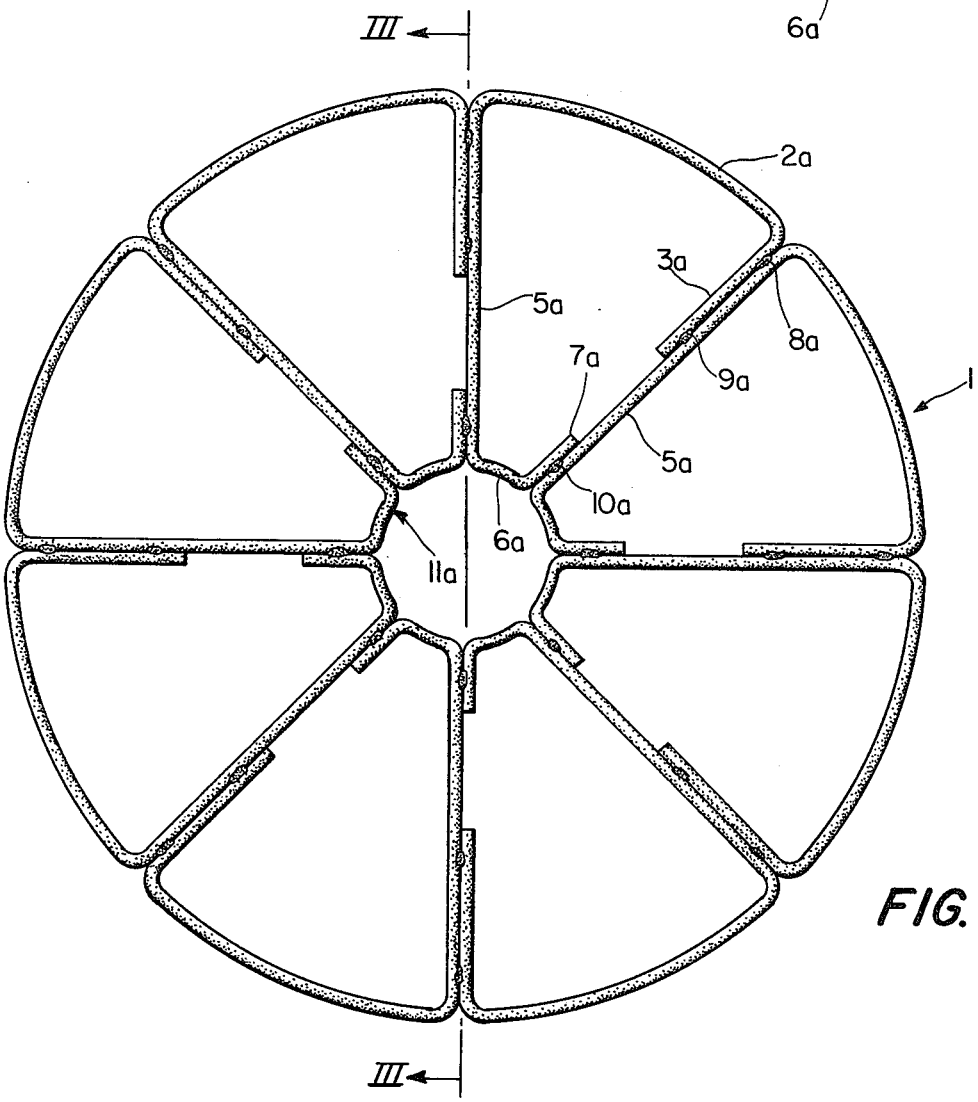
FIG. 2 is a side elevation of a reel constructed from a plurality of the elements of FIG. 1.
Figure 3:
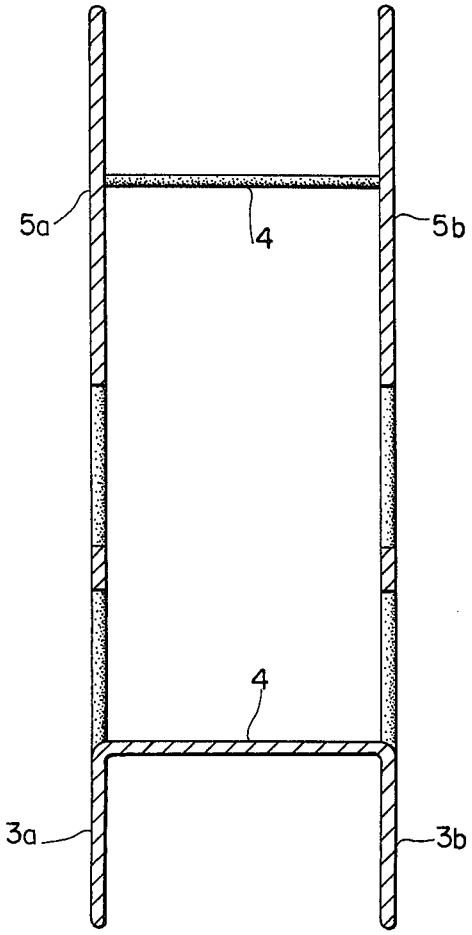
FIG. 3 is a cross-section on line III—III of FIG. 2.

FIGS. 2 and 3 show a reel constructed from eight elements 1 joined together in a circular array. The rims of the reel, made up of arcuate rim portions 2a, 2b are circular; elements having straight rim portions could, if desired, be used, thus forming a polygonal reel. The side member 5a of each element is joined by welds 8a, 9a to the side members 3a, and by a weld 10a to the stub 7a, of an adjacent member. The welds 8a, 9a are preferably spot welds to minimize the possibility of damage to material stored on the reel. The side members 5b, side members 3b and stubs 7b are similarly joined. Thus, in the completed reel, the transverse members 4 form a ring of members around which the filamentary material can be wound. The inner rim portions 6a (and similarly the portions 6b) together form a continuous ring 11a, the two rings forming a central bearing for mounting of the reel on a shaft.

Figure 4:
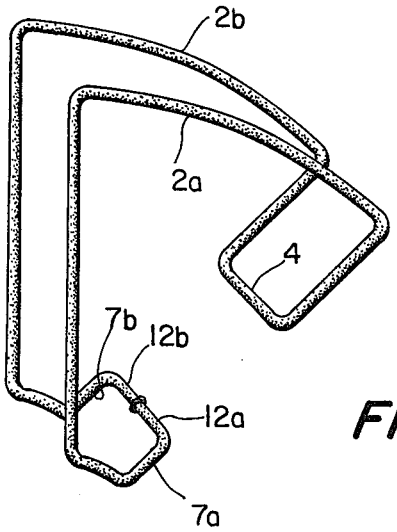
FIG. 4 is a view similar to FIG. 1 showing another embodiment of the reel element.

The element shown in FIG. 4 is similar to the element of FIG. 1 (like reference numerals being used for like parts) but the stubs 7a, 7b have axially extending portions 12a, 12b which are butt-welded together as at 13 to form a further transverse member 12. Such an element may conveniently be made by bending an initially planar rectangular wire loop.

Figure 5:
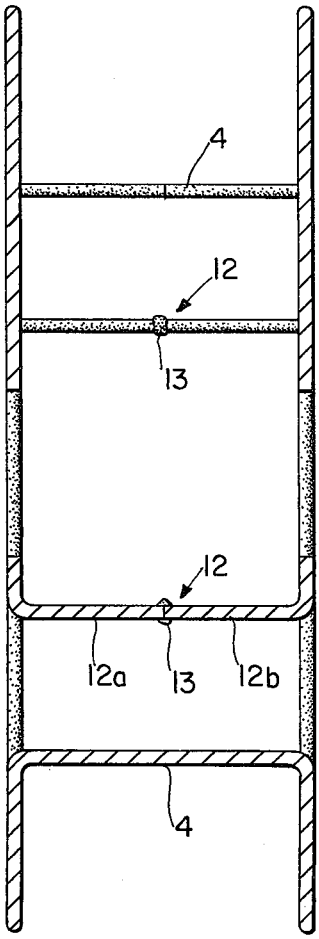
FIG. 5 is a cross-sectional view similar to FIG. 3 of a reel constructed from the elements of FIG. 4.

A reel constructed from eight elements as shown in FIG. 4 is shown in FIG. 5; it will be appreciated that the transverse members 12 provide additional rigidity to the structure, particularly in the region of the bearing rings.

What is claimed is:

1. A reel for the storage of filamentary material comprising a plurality of elements each made of a single piece of wire bent to form a sector of the reel and all secured together in a circular array, in which each element has two axially spaced circumferentially extending bearing portions at the radially innermost regions thereof, all of said bearing portions of the respective elements co-operating to define two axially spaced bearing rings for mounting the reel on a shaft.

2. A reel according to claim 1 in which each element is formed to provide two mutually opposed portions of respective rims of the reel, first and second side members extending radially inwardly from respective ends of each rim portion, and an axially extending transverse member between the first side members to form a supporting member for the filamentary material, and the bearing portions extend circumferentially from the radially innermost ends of the second side members.

3. A reel according to claim 2 in which each bearing portion has, at its end remote from its respective side member, a radially outwardly extending stub member, each stub member being secured to the second member of an adjacent element whereby the bearing portions are joined together to define said rings.

4. A reel according to claim 3 in which each element includes a further transverse member extending between the radially outer ends of the stub members of that element.

* * * * *